United States Patent [19]

Chiron et al.

[11] 4,144,434

[45] Mar. 13, 1979

[54] MICROWAVE HEATING DEVICES

[75] Inventors: Bernard Chiron; Michel de Vecchis, both of Paris, France

[73] Assignee: Societe Lignes Telegraphiques et Telephoniques, Paris, France

[21] Appl. No.: 695,919

[22] Filed: Jun. 14, 1976

[30] Foreign Application Priority Data

July 16, 1975 [FR] France ..... 75 22199

[51] Int. Cl.[2] ..... H05B 9/06

[52] U.S. Cl. ..... 219/10.55 F; 219/10.55 A; 333/248

[58] Field of Search ..... 219/10.55 R, 10.55 A, 219/10.55 F; 333/83 R, 83 A

[56] References Cited

U.S. PATENT DOCUMENTS

| | | | |
|---|---|---|---|
| 2,600,186 | 6/1952 | Banos, Jr. | 333/83 A |
| 3,376,524 | 4/1968 | Wang | 333/83 R |
| 3,461,261 | 8/1969 | Lewis et al. | 219/10.55 A |
| 3,555,232 | 1/1971 | Bleackley | 219/10.55 A |
| 3,571,551 | 3/1971 | Ogasawara | 219/10.55 A |
| 3,590,202 | 6/1971 | Day et al. | 219/10.55 A |

FOREIGN PATENT DOCUMENTS

| | | | |
|---|---|---|---|
| 1291429 | 3/1969 | Fed. Rep. of Germany | 219/10.55 F |
| 2417577 | 10/1974 | Fed. Rep. of Germany | 219/10.55 A |
| 611490 | 10/1948 | United Kingdom | 333/83 |
| 1317474 | 5/1973 | United Kingdom | 219/10.55 F |

OTHER PUBLICATIONS

Journal of Microwave Power, 9(2), 1974, p. 126.

*Primary Examiner*—J. V. Truhe
*Assistant Examiner*—Bernard Roskoski
*Attorney, Agent, or Firm*—Kemon & Estabrook

[57] ABSTRACT

In a microwave cylindrical heating $TM_{010}$ cavity for continuous heating of rods, wires, etc. . . focussing means are provided surrounding the entry and or the exit to locally concentrate the microwave energy on the object to be heated. Said means consists in 45° annular wedge. As variants focussing is achieved by ferromagnetic annulus.

1 Claim, 13 Drawing Figures

FIG.IB
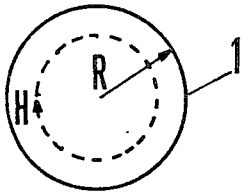
FIG.IC
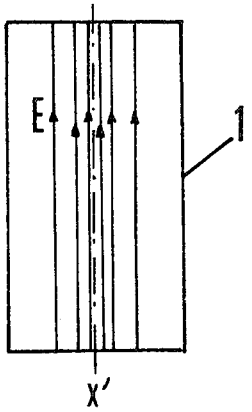
Fig:2
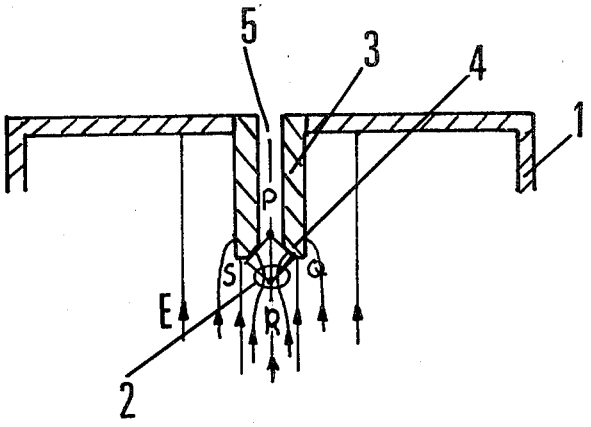
Fig:3
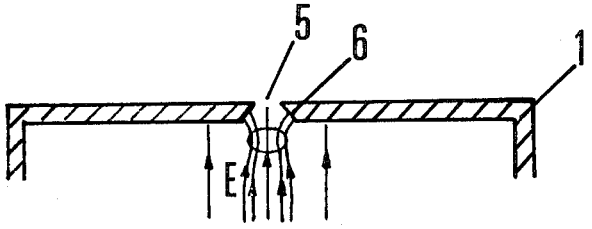

FIG. II
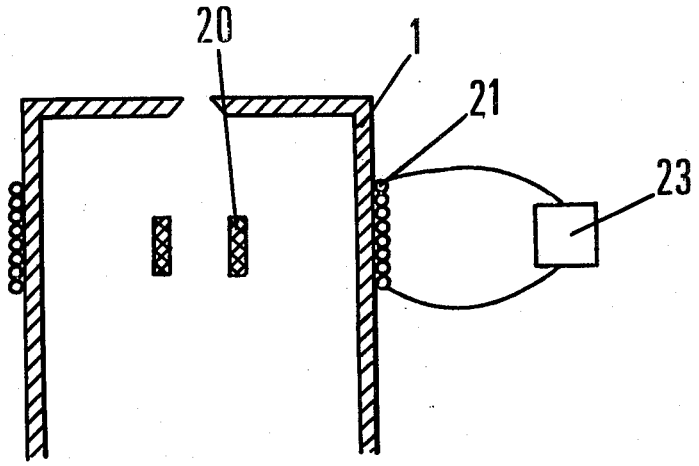
FIG. 1A
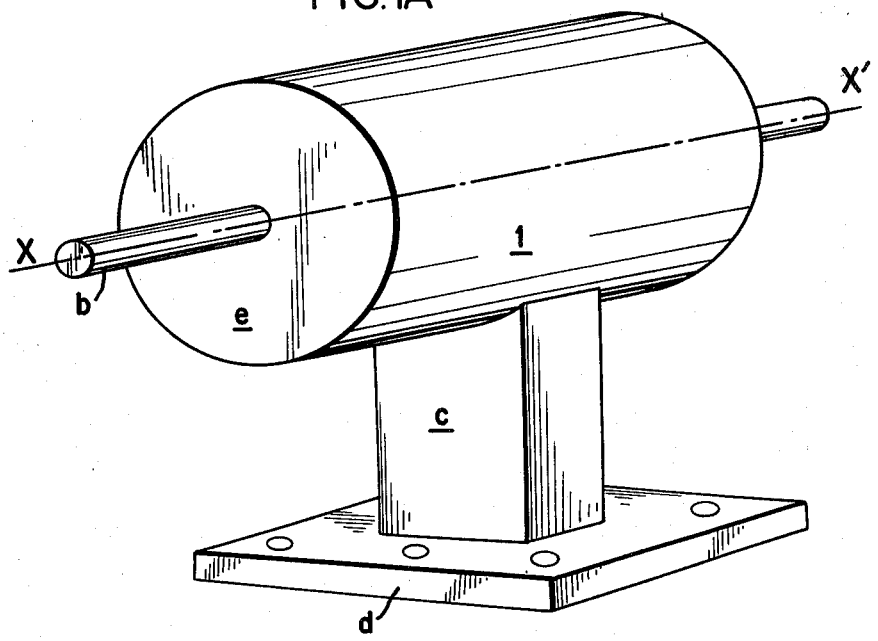

MICROWAVE HEATING DEVICES

BACKGROUND OF THE INVENTION

The present invention concerns improvements in microwave cavities constituting the body of heating devices more particularly intended for continuously heating elongate objects made of low dielectric loss material, such as silica and glass.

The constant development of telecommunications is naturally leading to the use of carrier waves of ever increasing frequencies. The use of optical-frequency waves has focussed the interest in light guides consisting of glass fibres and many works have already been published on this subject. The use of light guides as communication medium calls for the development of industrial processes for the manufacture of the fibre, as well as for the interconnection of the fibres. Research has already shown that the chemical composition of the fibre is basic. It is therefore essential to apply non-polluting processes for manufacturing and treating optical fibres. Microwave energy heating exhibits this quality. As compared with r.f. heating, it has the advantage that it can be focussed in space, so that it is possible, for example, to concentrate the available energy in a small volume and to reach a high energy density from a low consumed power despite the relatively poor yield of conversion of the mains energy into microwave energy. This feature is particularly interesting when the objects to be heated have small dimensions, at least in one direction. It will be recalled that the diameter of optical fibres employed in telecommunications is of the order of 150 micrometers at most and reaches several tens of microns in some designs, before sheathing.

Among the various cavities which can be used as microwave heating apparatus, the one most particularly adapted to the continuous heating of thin cylindrical objects is the cylindrical cavity excited in the $TM_{010}$ mode. A study of such a cavity employed as a heating device has been made by METAXAS (See "Design of a $TM_{010}$ Resonant Cavity as a Heating Device at 2.45 GHz " by A. C. METAXAS in Journal of Microwave Power 9(2), 1974, pp 123–128).

Some of results of this study are summed up hereunder: the electric field vector is parallel to the axis of the cylinder and its modulus is constant in a direction parallel to this axis and maximum in the neighbourhood of the said axis. The magnetic field lines are concentric circles whose plane is perpendicular to the axis and which are centred on the axis. This mode of excitation of the cavity therefore takes the axis of the cylinder as the axis of symmetry. The wavelength in the cavity depends only upon its radius and the energy density is maximum close to the axis. This cavity and this mode of excitation are therefore particularly well adapted to the continuous heating of cylindrical objects of small cross-section.

PRIOR ART

U.S. Pat. No. 3,461,261 filed by R. W. LEWIS et al on Oct. 31, 1966 discloses a cylindrical heating cavity operating in the $TM_{01n}$ mode. The patent is directed to the coupling between a feeding waveguide and the cylindrical cavity in order to provide for the required mode of propagation within the cavity and to tuning means and inclined end pieces so that the cavity is no more cylindrical, at least at the terminals.

U.S. Pat. No. 3,715,555 filed by R. M. JOHNSON on Apr. 19, 1972 describes a microwave powder heating device using a cylindrical cavity which is operated according to a circular $TM_{01}$ or $TE_{11}$ mode.

SUMMARY OF THE INVENTION

The present invention consists in improvements in a cylindrical cavity excited in the $TM_{010}$ mode for the purpose of favouring the heating of objects of low loss dielectric material, such as glass. In accordance with an essential feature of the present invention, there are associated with a cylindrical cavity excited in the $TM_{010}$ mode means which preserve the axial symmetry of the mode and which are intended to enhance the concentration of the electric field in a zone located in the neighbourhood of the axis of the cavity without disturbing the mode of excitation. More particularly, these means are disposed in the neighbourhood of the axis and more generally they surround the axial aperture or apertures provided in the said cavity to permit the passage of the objects to be continuously heated. They consist either of metallic elements which have small dimensions in relation to the cavity and which have a face of which the normal is inclined in relation to the axis of the cavity, at least at certain points, or of magnetic elements which are symmetrical about the axis of the cavity and the dimension of which are small in relation to those of the cavity. These magnetic elements may be associated with magnetization field coils or with a system of magnets creating a variable magnetic field permitting optional adjustment of the concentration.

BRIEF DESCRIPTION OF THE DRAWINGS

The invention will be readily understood from the following description and from the accompanying figures, which are given by way of non-limiting illustration and in which:

FIG. 1A is a perspective view of a microwave heating apparatus of the type to which the present invention is directed, FIGS. 1B and 1C are diagrammatic illustrations of the magnetic and electric field distributions within a cavity of the type shown in FIG. 1A, and FIGS. 2 to 11 illustrate variants of the invention.

DETAILED DESCRIPTION OF THE INVENTION

Figure 4:
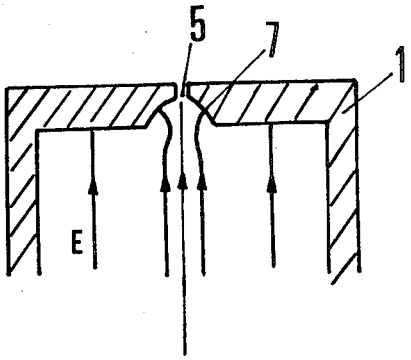

FIG. 1A is a perspective view of a heating device as described by Metaxas in the Journal of Microwave Power 9(2), 1974, pages 123–128. The cylindrical cavity is shown at 1. The object "b" to be heated is driven by means not shown along the longitudinal axis XX' of the cavity through openings in the end plates "e" and "f" of the cavity. A microwave power source, not shown, is connected to the feeding waveguide "c" at flange "d". Guide "c" transmits the energy to the cavity. The field established in the cavity is shown in FIGS. 1B and 1C.

In FIG. 1, a cylindrical cavity 1 is illustrated in transverse section and in longitudinal section respectively. There is shown at E in the longitudinal section the electric field lines and at H in the transverse section a magnetic field line corresponding to the $TM_{010}$ mode. Study of the condition of propagation in this cavity shows that the wavelength $\lambda$ as a function of the radius R of the cavity is given by the relation $\lambda = 2.61$ R in the absence of load. As will be seen, the electric field density is maximum in the neighbourhood of the longitudinal axis XX' of the cylinder and the intensity of the electric field is constant along a line parallel to this axis. The cavities which may be used for the microwave heating of elongate objects are obtained by providing along the axis XX' of the cavity two apertures permitting the passage of the object to be heated. Introduction of a load modifies the quality factor of the cavity and sometimes produces a variation of the resonance frequency which, for a correct coupling with the source, may be brought back to the initial value by means of a metallic movable plunger entering the cavity. This plunger is shown very diagrammatically at 3 in FIG. 2. Study of the behaviour of the cavity shows that the stability of the $TM_{010}$ mode requires that the depth of penetration of the plunger 3 into the cavity should not exceed one-quarter of the wavelength. In an exemplary construction of a cavity having a radius equal to 45 mm, this depth does not exceed 20 mm. Likewise, the central aperture of the plunger and/or of the terminal face of the cavity must be as small as possible. A practical value of the diameter of these apertures is 1.2 times the diameter of the object to be treated.

The object of the invention is essentially to effect an additional concentration of the energy in a zone located in the neighbourhood of the xis XX', which has small dimensions as compared with the cavity and which is preferably situated in the neighbourhood of the upper part of the cavity when the object to be continuously heated moves from the top downwards. This additional concentration of energy is particulary useful in the case of the heating of material having relatively low dielectric losses, such as silica and some glasses which contain a high proportion of silica. It is known that this type of material shows losses which increase rapidly with the temperature. A local increase of the energy absorbed by an elongate object makes it possible to obtain a local increase of the temperature, and due to the property just mentioned, a cumulative effect is started. It is thereby possible to heat an energy level insufficiently in itself to provide for the heating of the material under consideration to the desired temperature. This concentration of the energy in an excited cavity is effected with the aid of means which produce a very localised deformation of the field lines in the neighbourhood of the axis XX' of the cavity, in the upper part of the latter. When the cavity comprises a tuning plunger, these means consist, as illustrated in FIG. 2, which illustrates a first embodiment of the invention, of a chamfer 4 machined in the terminal face of the plunger 3 turned within the cavity, in the neighbourhood of the central aperture 5 permitting the passage of the object to be heated. As above, E is the field lines in the neighbourhood of the extremity of the plunger 3. As will be seen, since the conditions at the limits are modified by the presence of the chamfer 4, a concentration of the field lines occurs in the neighbourhood of the terminal face of the plunger 3 at a point which can be determined by calculation as a function of the geometrical parameters of the various metallic faces entering the cavity. Experience has shown that, by using a chamfer 4 at 45° to the axis XX' of the cavity, a central aperture 5 of 2 mm and a plunger having an external diameter of 6 mm, the maximum electric field concentration is obtained at a point P such that PQRS constitutes a square which is symmetrical about XX'. The existence of this point can be shown by the effect of point melting of a glass rod disposed in the cavity, the 2.450 GHz generator being adjusted to a power (of less than 500 W) which is insufficient to produce melting in the absence of focusing.

FIG. 3 constitutes a variant of FIG. 2, which can be used when the cavity does not contain a plunger 3. It is to be understood that the tuning can then be adjusted by means of a plunger entering the lower face of the cavity.

As will be seen, a chamfer 6 is machined in the thickness of the wall of the cavity 1 around the aperture 5 permitting the passage of the object to be heated. The deformation of the electric field lines is similar to that of the preceding example.

FIG. 4 illustrates a variant in which the concentration of the electric field lines is effected by the terminal face of the cavity 1, as in the example of FIG. 3, by means of a concave zone 7 surrounding the central aperture 5. In the variants which have just been described, the energy concentration is effected by locally modifying the distribution of the electric field lines without interfering with the fundamental $TM_{010}$ mode established in the cavity. The variants referred to in the following make it possible to obtain the concentration of energy by acting on the distribution of the magnetic field lines. In accordance with FIG. 5, this magnetic field concentration is effected in the neighbourhood of the axis XX' with the aid of a ring 10 of magnetic material which is disposed around the aperture 5 on the upper face of the cavity 1. This ring is optionally associated with a coil 9 supplied from an adjustable source. In the variant illustrated in FIG. 6, a ring of high permeability material 11 is disposed on the terminal face of the frequency tuning plunger 3. The use of an annular member such as 10 or 11 consisting of a material having high magnetic permeability brings about a localized variation of the reluctance, which produces an increase in the density of the magnetic field lines in the material, in the well-known manner. This localized deformation of the magnetic field is associated with a deformation of the electric field in the same zone, which results in an increase in the density of the electric energy in this zone. The use of a material of the ferrite type, of which the permeability varies with the applied magnetic field, associated with a winding or a system of permanent magnets, the position of which is adjustable for the purpose of creating a variable magnetic field, makes it possible to adjust the concentration of the energy as a function of the material to be heated and of the parameters of the operation.

Figure 7:
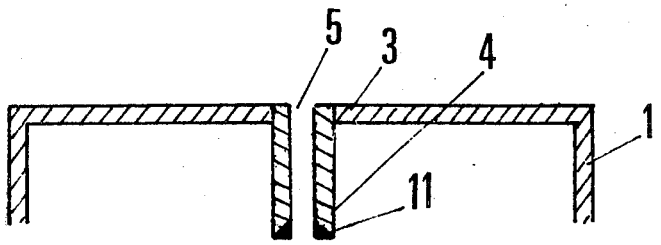
Figure 8:
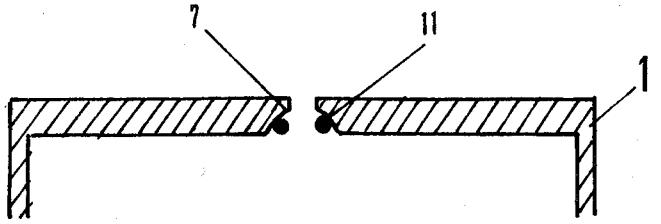
Figure 9:
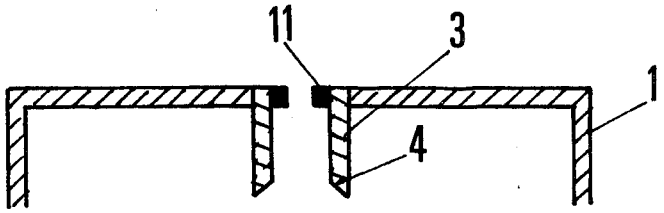

FIGS. 7, 8 and 9 illustrate embodiments in which use is made both of an electric field concentrating means and of a magnetic field concentrating means for bringing about a localized increase in the energy density in the neighbourhood of the axis XX'.

Figure 5:
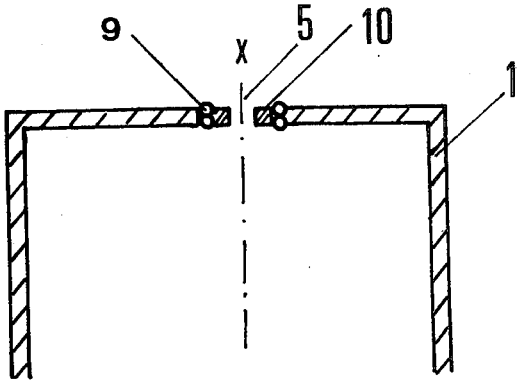
Figure 6:
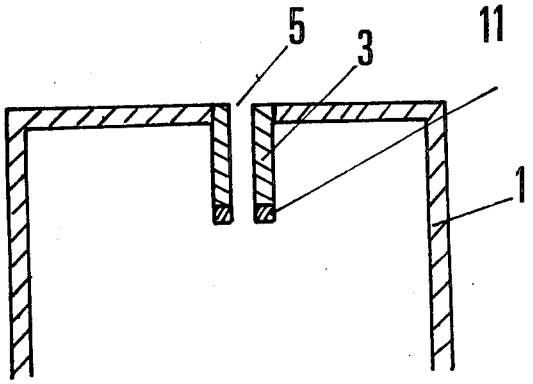
Figure 10:
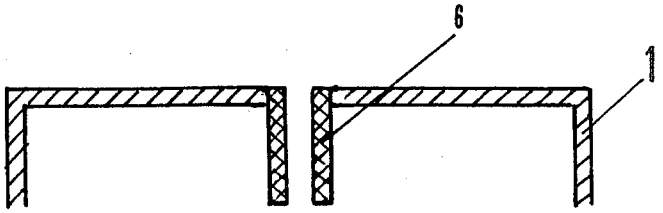

In the foregoing examples, it is assumed in the energy concentration that the $TM_{010}$ mode has been established in the cavity and is stable. However, the material employed (and its dielectric properties) differs notably depending upon the type of fibre manufactured. For the purpose of adapting the furnace to various materials, to the various dimensions of the preforms used and to the physical conditions of the operation, it is necessary to have available an adjusting member which adapts the load to the cavity in optimum manner. This adaptation is effected in accordance with the present invention with the aid of an adjustable magnetic field applied to the ring of magnetic material which is disposed in the cavity in the embodiments of FIGS. 5, 6, 7, 8 and 9. As is illustrated in FIG. 5, it is sufficient to provide a winding such as 9 around at least one part of the ring and to supply it from an adjustable current source. In each case, this optimum adjustment is experimentally effected. A system of permanent magnets permitting a displacement in relation to the ring can perform the same function. For the purpose of obtaining a possibility of maximum adjustment, it may be desirable to make the whole of the plunger of magnetic material, as illustrated at 6 in FIG. 10.

In a variant illustrated in FIG. 11, there is disposed in the cavity, in the neighbourhood of the axis, a hollow cylinder 20 of magnetic material, optionally associated with a winding 21 supplied with current by an adustable source 23. The presence of the member 20 brings about an increase in the microwave magnetic field density and therefore of the electric field density, in the neighbourhood of the axis, that is to say, in the zone through which the object to be heated passes. Magnetic materials which have given good results are marketed by the Applicants under the numbers 6905 (American equivalent G 1004 of Trans Tech.) and 6902 (equivalent to the material Y 11). The choice of the magnetic material is not critical, since it merely performs the function of establishing a localized magnetic field.

In the foregoing, there have been set forth concentrating means which form a hot point along or in the neighbourhood of the axis XX'. It is to be understood that the same means may be used in the neighbourhood of the lower face of the cavity so as to set up a second hot point in the object which travels continuously through the cavity. It is thus possible to subject the object to a temperature gradient by means of which annealing can be effected if desired. Of course, the improved cavity according to the invention may be given any application. However, it is particularly advantageous in the case of optical fibres. The production of optical fibres which can be used in telecommunications presents two different problems necessitating the fusion of the material, or at least a considerable softening thereof: the formation of the fibre proper from a preform consisting of a glass of given composition by elongation of the latter effected by drawing the apropriately softened tube. This operation is described in Annales des Telecomunications by Mr. PASSARET (May-June 1974). The existence of a hot point is then particularly advantageous because it makes it possible to define with precision the zone in which the drawing takes place, the remainder of the material being maintained at a temperature at which deformation will not occur. In a microwave cavity of the same type, comprising no focusing means, the energy is uniformly distributed along the whole axis and the heating of the object is more uniform.

The second object which can with advantage be resolved by the use of cavities according to the invention is the junction of two optical fibres by fusion. The existence of the hot point in the neighbourhood of the axis makes it possible to initiate a rapid softening of the two ends of the fibres which have to be joined with the aid of a relatively weak power source.

What we claim is:

1. In a cylindrical microwave cavity of the type having entrance and exit apertures in opposite end walls and aligned on the longitudinal axis of the cavity and in which the cavity is excited in the $TM_{010}$ mode for the heating of thin thread-like objects fed continuously through the cavity along the longitudinal axis thereof, a hollow plunger positioned in said entrance aperture and having a cylindrical passageway coaxial with the longitudinal axis of the cavity, the inner end of said passageway being conically flared at an angle of 45° to said axis, said plunger being a focusing means for concentrating the energy at a point on said axis near said entrance aperture without disturbing the mode distribution therein.

* * * * *